US009153351B2

(12) United States Patent
Tache et al.

(10) Patent No.: US 9,153,351 B2
(45) Date of Patent: Oct. 6, 2015

(54) OPTICAL DEVICE FOR ANALYZING A SPECIMEN BY THE SCATTERING OF AN X-RAY BEAM AND ASSOCIATED COLLIMATION DEVICE AND COLLIMATOR

(75) Inventors: Olivier Tache, Palaiseau (FR); Olivier Spalla, Paris (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 259 days.

(21) Appl. No.: 13/643,407

(22) PCT Filed: Apr. 26, 2011

(86) PCT No.: PCT/IB2011/051805

§ 371 (c)(1),
(2), (4) Date: Nov. 30, 2012

(87) PCT Pub. No.: WO2011/135510

PCT Pub. Date: Nov. 3, 2011

(65) Prior Publication Data

US 2013/0064354 A1 Mar. 14, 2013

(30) Foreign Application Priority Data

Apr. 26, 2010 (FR) ..... 10 01774

(51) Int. Cl.
*G21K 1/02* (2006.01)
*G21K 1/06* (2006.01)

(52) U.S. Cl.
CPC *G21K 1/02* (2013.01); *G21K 1/025* (2013.01); *G21K 1/06* (2013.01); *G21K 2201/06* (2013.01); *G21K 2201/067* (2013.01)

(58) Field of Classification Search
CPC G21K 1/02; G21K 2201/06; G01N 2223/316
USPC ..... 378/145, 147
See application file for complete search history.

(56) References Cited

U.S. PATENT DOCUMENTS

| | | | | |
|---|---|---|---|---|
| 6,594,341 | B1 | 7/2003 | Lu et al. | |
| 2008/0037709 | A1* | 2/2008 | Yatsenko | 378/145 |
| 2009/0257563 | A1* | 10/2009 | Karlsson | 378/145 |
| 2011/0255662 | A1* | 10/2011 | Shannon, Jr. | 378/44 |

FOREIGN PATENT DOCUMENTS

| | | | | |
|---|---|---|---|---|
| JP | 05107400 | * 10/1991 | ..... | G21K 7/00 |
| JP | 5 107400 | 4/1993 | | |

OTHER PUBLICATIONS

International Search Report Issued Jul. 25, 2011 in PCT/IB11/51805 Filed Apr. 26, 2011.

* cited by examiner

*Primary Examiner* — Michael Maskell
(74) *Attorney, Agent, or Firm* — Oblon, McClelland, Maier & Neustadt, L.L.P.

(57) ABSTRACT

A collimation device for an X-ray beam, an optical device for analyzing a specimen by the scattering of an X-ray beam, and a collimator for an X-ray beam. The collimation device includes an enclosure configured to be under a vacuum or a controlled atmosphere, the enclosure including an inlet and an outlet for the X-ray beam and at least one plate made of a material having a diffracting periodic structure, the plate including two main faces and at least one flared aperture between the faces.

22 Claims, 2 Drawing Sheets

(a)

(b)

OPTICAL DEVICE FOR ANALYZING A SPECIMEN BY THE SCATTERING OF AN X-RAY BEAM AND ASSOCIATED COLLIMATION DEVICE AND COLLIMATOR

The present invention pertains to the field of the analysis of a specimen by X-ray scattering.

It relates especially to a collimation device for an X-ray beam, an optical device for the analysis of a specimen by X-ray scattering comprising this collimation device and, a collimator for such a beam.

Within the framework of the invention, the expression X-ray beam is intended to mean a beam of photons whose energy is between 1 keV and 30 keV.

In particular, the invention pertains to the field of the analysis of a specimen by X-ray scattering at small angles. The expression scattering at small angles must be understood to imply that the rays scattered by a specimen traversed by the beam (perpendicular incidence) to be analyzed lie in proximity to the X-ray beam by which the specimen is illuminated, in an angle of generally between 0.1° and 10° with respect to the optical axis of the beam. It is also possible to consider an orientation of the specimen positioned not perpendicularly to the beam but at grazing incidence with respect to the latter.

The techniques based on X-ray scattering at small angles are also known by the acronym SAXS signifying "*Small Angle X-Rays Scattering*" ("Small-Angle Scattering of X-rays", André Guinier and Gérard Foumet, ed. John Wiley and Sons Inc., 1955).

By virtue of these techniques, it is especially possible to obtain information about the organization of molecular systems of the specimen.

A known optical device for implementing a SAXS technique is represented in FIG. 1, according to an exploded perspective view.

The device comprises an X-ray source 10.

The beam 1 generated by the source 10 is then directed toward a monochromator mirror 11, which makes it possible to produce a monochromatic beam, that is to say containing only one X-ray wavelength. Typically, a beam is considered to be monochromatic when the ratio between the wavelength discrepancy and the desired wavelength is less than 1%.

It should however be noted that a nonmonochromatic X-ray beam could be used.

The beam exhibits a preferential axis of propagation called the "optical axis". Transversely to the optical axis, the beam exhibits a quasi-uniform cross-section when so-called "collimating" mirrors are used, i.e. convergent toward a distant point when so-called "convergent" mirrors are used.

In both cases, the geometric definition of the beam on exit from the monochromator is not sufficient to carry out scattering experiments at small angles. The expression geometric definition is intended to mean the real difference between a perfect geometry (parallel or convergent) of the beam and that which is physically obtained.

Better definition of the beam is thus obtained by collimation with a series of obstacles placed along the axis of the beam after the monochromator. The term "obstacle" is understood to mean a device opaque to X-rays at the wavelength employed.

In a conventional setup represented in FIG. 1, the first "obstacle" generally corresponds to four movable lips opaque to X-rays, referenced 12. Two parallel lips with a spacing D in the plane perpendicular to the axis of the beam define a "slit". Two pairs of lips thus arranged, form a hole. A collimator is more generally formed of two "holes" whose centers must be aligned with the optical axis of the beam exiting the monochromator.

The first obstacle, taking the form of a plate 12 furnished with two pairs of lips forming these two slits, thus forms a hole.

The plate 12 furnished with the two pairs of "lips" may be integrated into the mirror 11.

The plate 12 is generally followed by a calibrated attenuator (not referenced).

The beam is thereafter directed toward a second obstacle for collimation, placed some distance from the first obstacle along the optical axis of the beam. This second obstacle also takes the form of a plate 13 comprising two pairs of parallel lips, so as to form two slits whose centers are aligned with the optical axis of the beam.

The optical path between the two series of collimation "slits" may be placed under vacuum. Sometimes, it may, as a variant, be placed under a helium atmosphere.

The coupling of the two collimation means 12 and 13 makes it possible to delimit the size of the beam that it is desired to obtain at the level of the specimen 16.

On exit from the first evacuated enclosure 14, the beam passes through a third pair of slits 15, which are placed along the optical axis just before the specimen to be analyzed. These so-called "anti-scattering" slits do not, properly speaking, form parts of the collimator. Indeed, the anti-scattering slits 15 make it possible to eliminate the spurious scatterings produced by the slits of the collimation means 12 and 13.

Adjustment of the anti-scattering slits 15 is particularly tricky, since it is necessary to skim past the beam without touching it in order to eliminate the spurious scatterings without modifying the size of the beam.

The interaction of the beam 1 with the specimen 16 causes scattering of the X-rays, the beam being moreover transmitted at least in part through the specimen.

The transmitted beam and the scattered part are then gathered in a second evacuated enclosure 18 at the end of which is a means 19 for halting the beam. The evacuated enclosure makes it possible to limit at one and the same time the additional absorption by air, of the scattered rays and the complementary scattering of the beam 1 likewise by air.

A detector 20, situated downstream of the means 19 for halting the beam 1, then makes it possible to detect the X-rays scattered by the specimen.

Finally, the importance should be noted of the plate 12 furnished with collimation slits (first obstacle), the plate 13 also furnished with collimation slits (second obstacle) and the anti-scattering slits 15, without which it would be difficult to detect the X-rays scattered by the specimen, in particular the rays scattered at small angles which lie in proximity to the optical axis of the beam.

The relative position of the various obstacles 12, 13 and 15 is also important in regard to this aim.

As mentioned previously, these obstacles 12, 13, are generally four independent lips forming rectangular or square slits. These lips are furnished with vanes which may be displaced to adjust the dimensions of a slit. These vanes are metallic and generally made of steel, tantalum or constructed of tungsten rods.

The arrangement of a vane 21 at the level of a slit is for example represented in FIG. 2, according to a sectional view. Conventionally, such a vane 21 exhibits a thickness of about 1.5 mm.

Recently, it has been proposed that the monocrystalline structure vanes be arranged on the metallic vanes. Hereinafter, these vanes will be referred to as hybrid vanes.

The expression monocrystalline structure vane should be understood to imply that the material forming the vane is made of a single solid material exhibiting an elementary mesh cell that repeats in a regular manner, so as ultimately to form an ordered structure.

A hybrid vane such as this, comprising a metallic vane 21 and a monocrystalline structure vane 22, is for example represented in FIG. 3, according to the same sectional view as FIG. 2.

It is for example possible to cite the document "*Scatterless hybrid metal-single crystal slit for small-angle X-ray scattering and high-resolution X-ray diffraction*", Youli & al., J. Appl. Crystallography (2008), vol. 41, pp. 1134-1139 (D1).

The authors of this document have shown that arranging monocrystalline structure vanes formed from a silicon wafer carefully sliced and glued onto the metallic vanes made it possible to reduce the X-ray scattering generated by the slits.

Applied to the optical device described hereinabove, the slits furnished with these vanes therefore make it possible to improve the quality of the device.

Indeed, the monocrystalline structure which is placed at the vane edge returns the X-rays at well defined angles which depend on the crystalline plane of this structure. These angles are large enough not to merge with the beam.

When hybrid slits are installed in the optical device represented in FIG. 1, they make it possible to collimate the beam without producing spurious scattering.

The slit proposed by Youli & al. therefore makes it possible to simplify the optical device and, therefore, its adjustment.

However, the hybrid slit exhibits a more complicated structure than the slits with metallic vanes.

Therefore, the displacement of the vanes is also more complex, in particular if the slits are required to be installed under vacuum or in a controlled atmosphere, such as helium (He).

Moreover, the fabrication method employed by Youli & al., namely the slicing of a vane from a silicon wafer, generates a surface state of the monocrystalline structure vane which could lead to spurious scatterings: the benefit of the hybrid slit would thus be lost.

An objective of the invention is to propose a simplified optical device comprising at least one device for collimating an X-ray beam exhibiting the advantages of a hybrid slit without exhibiting at least one of the drawbacks thereof.

Another objective of the invention is to propose a collimation device for an X-ray beam, in particular adapted to be implemented in this optical device.

An objective is further to propose a collimator of an X-ray beam, in particular intended to be used in this collimation device.

To achieve at least one of these objectives, the invention proposes a collimation device for an X-ray beam, characterized in that it comprises an enclosure intended to be placed under vacuum or controlled atmosphere, the enclosure comprising an entrance and an exit for the beam as well as at least one plate made of a material with diffracting periodic structure, said plate comprising two principal faces and at least one aperture broadening out between said faces.

The collimation device will be able to provide other technical characteristics, taken alone or in combination:

- one of the principal faces of said at least one plate being an upstream face, with reference to the direction of propagation of the beam, and the other being a downstream face, the aperture widens out from the upstream face to the downstream face of the plate;
- said at least one plate made of material with diffracting periodic structure is arranged at the level of the exit of the enclosure;
- there is provided, at the level of the entrance of the enclosure, at least one other plate made of a material with diffracting periodic structure, this other plate comprising two principal faces and at least one aperture broadening out between said faces;
- one of the principal faces of said at least one other plate being an upstream face, with reference to the direction of propagation of the beam, and the other being a downstream face, the aperture widens out from the upstream face to the downstream face of the plate;
- the two plates are identical;
- the two plates exhibit different apertures;
- the acute angle θ formed between a direction D of broadening out of the aperture and one of said principal faces is between 10° and 80°;
- the angle θ is equal to the angle between two crystalline planes of the material of diffracting periodic structure forming the plate;
- the principal faces of the plate correspond to the {100} plane of the monocrystalline material and the faces of the aperture connecting said principal faces of this plate correspond to the {111} plane;
- the or each plate is made of a monocrystalline material;
- the or each plate is made of a material chosen from among silicon or germanium.

The invention also proposes an optical device for analyzing a specimen by scattering of an X-ray beam, characterized in that it comprises a device for collimating the beam according to the invention.

The optical device will be able to provide other technical characteristics, taken alone or in combination:

- an X-ray source;
- the X-ray source produces a monochromatic beam;
- another enclosure intended to be placed under vacuum or controlled atmosphere, this other enclosure, arranged downstream of the specimen, comprising a means for stopping the X-ray beam;
- a detector, arranged downstream of the other enclosure.

The invention further proposes a collimator for an X-ray beam, characterized in that it comprises several parts, each part, made of a material with diffracting periodic structure, comprising at least one aperture broadening out in the thickness of this part, the faces of the aperture formed by the assembly of apertures of each part of the collimator forming a sawtooth structure along the longitudinal axis of this aperture.

The collimator will be able to provide other technical characteristics, taken alone or in combination:

- each of its parts is formed of a plate, the plates being adjoining;
- the plates are identical.

Finally, the invention proposes a use, in the guise of collimator for an X-ray beam, of at least one plate made of a material with diffracting periodic structure, said plate comprising two principal faces and at least one aperture broadening out between said faces.

This use will also be able to provide:

- a use in which the acute angle θ formed between a direction D of broadening out of the aperture and one of said principal faces is between 10° and 80°;
- a use of several identical plates adjoining one another.

BRIEF DESCRIPTION OF THE DRAWINGS

Other characteristics, aims and advantages of the invention will be stated in the description detailed hereinafter given with reference to the following figures:

FIG. 7(*b*) is a sectional view of the plate depicted in FIG. 7(*a*);

FIG. 8(*b*) is a magnified view of the collimator of FIG. 8(*a*).

DETAILED DESCRIPTION OF THE EMBODIMENTS

Figure 4:
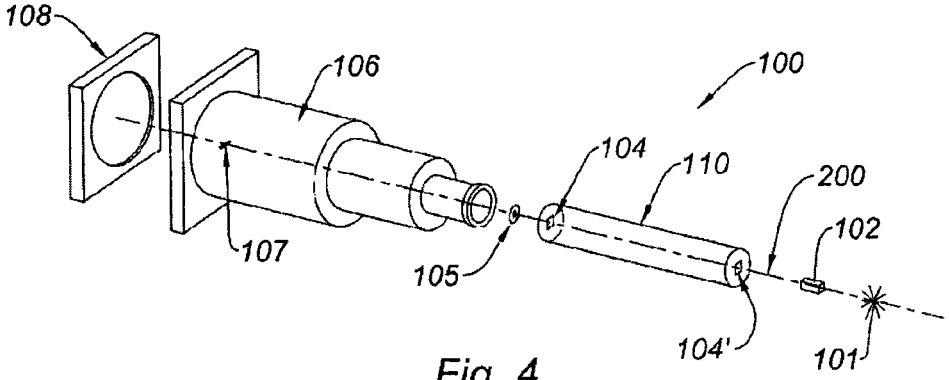
FIG. 4 is a schematic showing an exploded perspective view of an optical device according to the invention including an enclosure through which the x-ray beam transits.

An optical device 100 for analyzing a specimen 105 by X-ray scattering according to the invention is represented in FIG. 4.

This optical device 100 comprises a source 101, 102 of X-rays, producing a monochromatic beam. This source 101, 102 comprises, in a known manner, the actual source 101 of X-rays and a monochromator mirror 102.

In this instance, the actual source 101 of X-rays is a point source, but it could be otherwise, for example a line source. Moreover, the source 101, 102 need not be monochromatic, in accordance with the definition provided above.

Throughout the description which follows, the terms "upstream" and "downstream" will be used with reference to the direction of propagation of the X-ray beam.

Downstream of the source 101, 102 of X-rays, the device comprises a first enclosure 110 intended to be evacuated or under a controlled atmosphere, such as or helium (He).

This first enclosure 110 comprises an entrance and an exit for the beam, at the level of each of which is arranged at least one plate 104, 104' made of a material exhibiting a diffracting periodic structure according to the invention.

Generally, this diffracting periodic structure will be a monocrystalline structure.

These plates 104, 104' are preferably mounted against the end walls 120, 121 of the enclosure 110, inside the enclosure 110. The positioning of these plates 104, 104' is therefore easy. These walls 120, 121 form moreover, respectively, the entrance for the X-ray beam and the exit for said beam.

Figure 5:
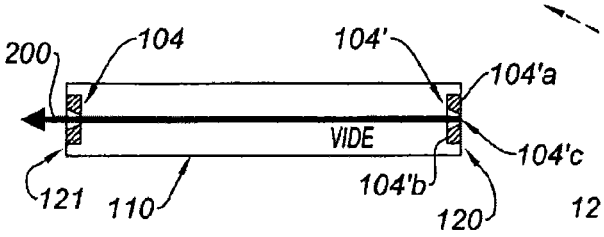
FIG. 5 is a sectional view of the enclosure depicted in FIG. 4.
Figure 7:
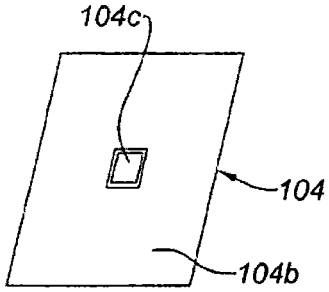
FIG. 7(*a*) is a perspective view of a plate, according to the invention, made of a material of monocrystalline structure and having therein an aperture.
Figure 7:
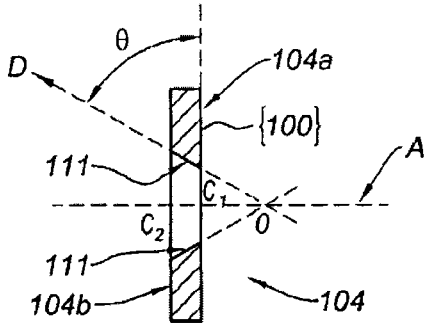

This enclosure 110 is represented in a sectional view in FIG. 5. Moreover, a plate 104 made of a material of diffracting periodic structure according to the invention is represented in FIG. 7.

Each plate 104, 104' comprises two principal faces, and more precisely an upstream face 104*a*, 104'*a* and a downstream face 104*b*, 104'*b* as well as an aperture 104*c*, 104'*c* widening outing out between the upstream face and the downstream face of the plate considered.

As is represented in the appended figures, the plate 104, 104' is arranged in such a way that the aperture 104*c*, 104'*c* broadens out from upstream to downstream, with reference to the direction of propagation of the beam.

However, the same plate 104, 104' could be arranged in the opposite direction, that is to say so that the aperture 104*c*, 104'*c* narrows from upstream to downstream, with reference to the direction of propagation of the beam.

The thinning of the plate avoids the reflection of the X-rays of the beam which propagate at small angles, i.e. at grazing incidence.

Moreover, the acute angle θ formed between a direction D of widen outing out of the aperture and any one of the upstream or downstream faces of the plate can be between 10° and 80°. The angle θ is for example represented in FIG. 6.

In particular, the angle θ may be equal to the angle between the crystalline planes {100} and {111} of the material forming the plate 104. This characteristic may be obtained when the method for fabricating the plate, of chemical nature, is wet anisotropic etching. Indeed, with this method, the chemical attack of the material takes place between the {100} and {111} crystalline planes. The surface state obtained is thus of very good quality.

The notations {100} and {111} correspond to the Miller indices. They make it possible to designate the planes in a crystalline material. These indices are well known to a person active in the field of crystallography and commonly accepted.

In the case of silicon, it is possible to use a solution of potassium hydroxide (KOH). As a variant, it is also possible to use a process which is less selective relative to etching between the {100} and {111} crystalline planes, by using a solution of tetramethylammonium hydroxide (TMAH).

Moreover, the widen outing out of the aperture 104*c*, 104'*c* may be referred to as uniform. The expression uniform widening out should be understood to imply that the change of dimension that the aperture undergoes between the upstream face and the downstream face of the plate takes place according to a homothety. The center O corresponds to the intersection between the axis A passing through the centers $C_1$, $C_2$ of the aperture at the level, respectively, of the upstream and downstream faces of the plate with the axis of direction D mentioned hereinabove. It will be possible to refer to FIG. 7(*a*).

Preferably, the upstream faces 104*a*, 104'*a* or downstream faces 104*b*, 104'*b* of the plate 104 made of a material of diffracting periodic structure correspond to the {100} plane of this structure. The faces of the plate that are inclined with respect to the upstream and downstream faces then correspond to the {111} plane of the structure.

As a variant, a mechanical method could be employed to define an angle in the range mentioned hereinabove.

By thus arranging two plates, one 104' at the entrance of the enclosure 110, the other 104 at the exit of the enclosure 110, an X-ray collimator is then obtained.

Figure 1:
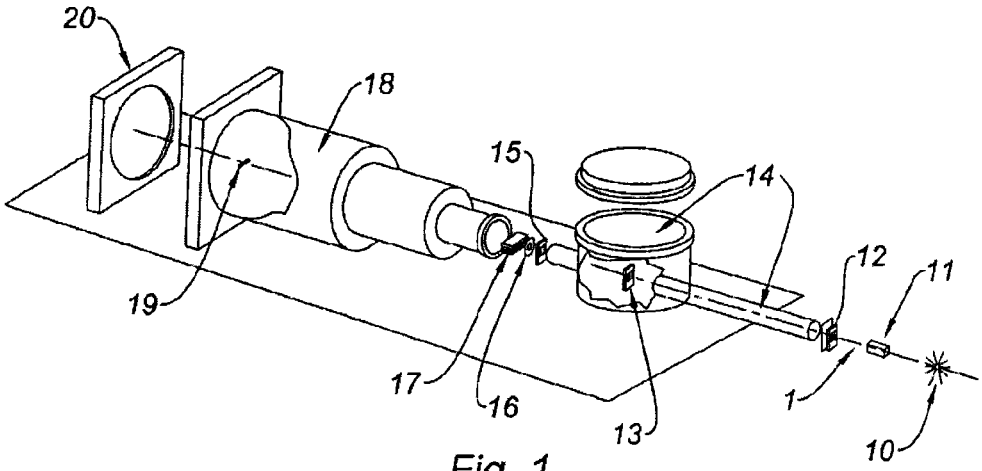
Fig. 1 (Prior art)
FIG. 1 is a schematic of an optical device for implementing a Small Angle X-Rays Scattering (SAXS) technique.
Figure 2:
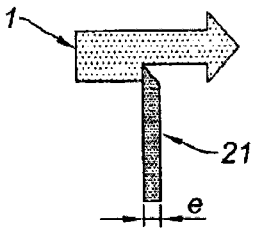
Fig. 2 (Prior art)
FIG. 2 is a sectional view of a vane at the level of a slit interacting with the x-ray beam for collimation of the x-ray beam.
Figure 3:
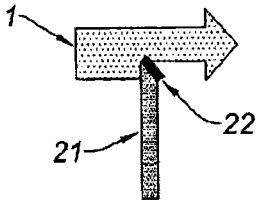
Fig. 3 (Prior art)
FIG. 3 is a schematic of a hybrid vane including a metallic component and a monocrystalline component.

The plate 104' can for its part be inserted in place of the plate with slits 12 of the device according to the prior art represented in FIG. 1, so as to collimate the beam without generating spurious scattering. The plate 104 then avoids any spurious scattering on the collimated beam and can also improve collimation, before the beam strikes the specimen 105.

The plates 104, 104' thus exhibit the same functions as a hybrid slit proposed in document D1.

Downstream of the specimen 105, the optical device 100 comprises already known means of the optical device represented in FIG. 1. This entails a second enclosure 106 also intended to be under vacuum (or under a controlled atmosphere) comprising, at its opposite end from the entrance of the beam in the enclosure 106, a means 107 for stopping the beam.

Finally, the optical device 100 comprises a detector 108, arranged downstream of the second enclosure 106.

The plates 104', 104 arranged respectively at the entrance and the exit of the first enclosure 110 may be identical.

The plates 104, 104' can moreover be made of silicon, the angle θ between the {100} and {111} crystalline planes then being about 54.7° if a solution of KOH for example has been used. The shape of the aperture is then defined by the crystalline planes.

Here, the aperture of a plate 104, 104' may be square or rectangular and the broadening out between the upstream face and the downstream face is given by the angle Θ. For example, when this aperture is square, its side, at the level of the upstream face 104*a*, 104'*a* of the plate 104, 104', may be 1 mm.

Other shapes of apertures are conceivable. It is for example possible to refer to the article "*A flux and Background-optimized version of the NanoSTAR small-angle X-ray scattering camera for solution scattering*", Jan Skov Pedersen, J. of Applied Crystallography (2004), 37, pp. 369-380.

A plate 104, 104' can exhibit a dimension of about 10 mm*10 mm, and a thickness of about 1-2 mm.

As a variant, they may be different, especially because their apertures 104*c*, 104*c*' are different. Indeed, the apertures 104*c*, 104*c*' of these plates can differ by their dimensions and/or by the value of the angle θ.

Also as a variant, each plate 104, 104' may be made of a material of diffracting periodic structure, other than silicon, in this instance monocrystalline. For example, it may involve a monocrystalline structure like germanium.

The optical device represented in FIG. 4 can form the subject of variant embodiments.

A variant embodiment can consist in replacing the assembly formed by the collimation means 13 and the anti-scattering slits 15 of the optical device according to the prior art represented in FIG. 1 by a plate 104 according to the invention.

Figure 6:
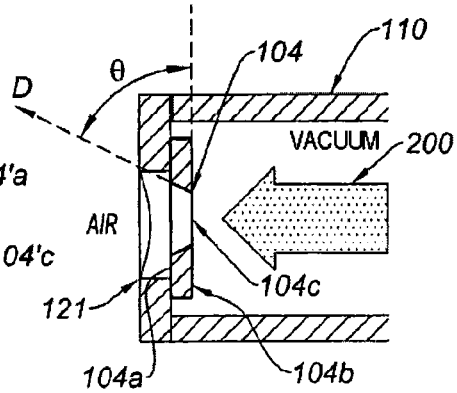
FIG. 6 is a magnified sectional view of the enclosure depicted in FIG. 5.

This plate 104 is then arranged at the exit of an enclosure intended to be under vacuum (or under a controlled atmosphere), as represented in FIG. 6, so as to form a device for collimating X-rays. On the other hand, this enclosure does not comprise a plate according to the invention at the level of its entrance, but this entrance is preceded by the slits 12 and, if appropriate, the calibrated attenuator (not referenced) as illustrated in FIG. 1.

Figure 8:
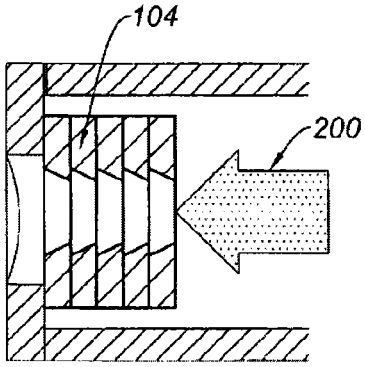
FIG. 8(*a*) is a partial sectional view of an enclosure for installation in the device of FIG. 4, comprising at the level of its end a collimator including multiple plates.
Figure 8:
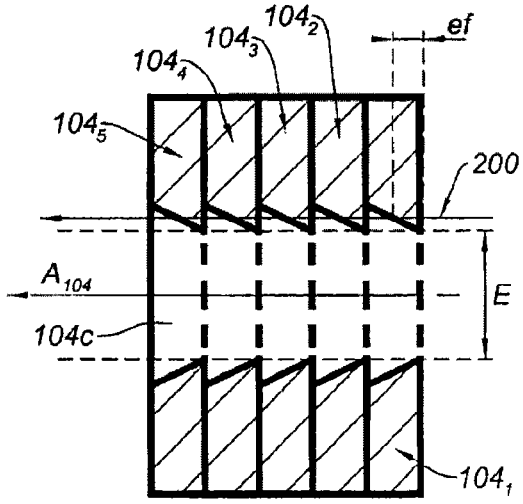

Another variant embodiment of the invention is represented in FIG. 7 or 8.

According to this variant, there is provided a collimator of the X-ray beam comprising several plates made of a monocrystalline material, adjoining one another so that said at least one aperture of each plate widens out between the upstream face and the downstream face of the plate or the converse.

These adjoining plates will generally be identical.

The benefit of this arrangement is to limit, or indeed to eliminate, the transmission of the beam 200 through the monocrystalline material, at the level of the outline of the aperture.

Indeed, when a single plate is provided, it is understood that the plate thickness $e_f$ encountered by the beam 200 is small at the level of the outline of this aperture. By adjoining several plates, the plate thickness ultimately encountered by the beam 200 at the level of this outline of the aperture, which exhibits a sawtooth shape along the longitudinal axis of the aperture, is thus increased.

The collimation of the beam 200 is thereby improved, by transmitting only the beam passing through the space E left by the aperture, on the upstream side of the plate.

This is particularly beneficial if the plate is made of silicon. When the plate is made of germanium, which is a denser material than silicon, this arrangement will exhibit particular benefit for the energy range of the X-rays from 15 keV to 30 keV.

It should be noted that, in FIG. 7, five identical plates adjoining one another have been represented. The person skilled in the art will understand that this is merely an illustration and that the number of plates to be considered will depend especially on the energy of the beam, the thickness of a plate and the nature of the monocrystalline material forming this plate.

The applicant has carried out measurements and performed a few calculations.

It was found that for an X-ray beam of 8 keV, the superposition of three identical silicon plates each about 1-2 mm thick was equivalent to using a germanium plate, of the same thickness. For an X-ray beam of 17 keV, it is then necessary to adjoin fifteen of these same silicon plates to obtain behavior equivalent to a germanium plate of the same thickness.

The adjoining of plates may be envisaged at each end of the enclosure 110 represented in FIG. 5. This can also be envisaged solely at the entrance or solely at the exit of this enclosure 110, in particular if this exit alone comprises a plate 104 in accordance with the invention.

Alternatively, it is possible to provide a collimator not comprising adjoining plates, but made from a single piece each of whose various parts $\mathbf{104}_1$, $\mathbf{104}_2$, $\mathbf{104}_3$, $\mathbf{104}_4$, $\mathbf{104}_5$ can be regarded as a plate 104 such as described above. Thus, the faces of the aperture 10C formed by the assembly of apertures of each part of the collimator forms a sawtooth structure along the longitudinal axis $A_{104}$ of this aperture 104C. The shape of this aperture 104C, for example represented in FIG. 8, is thus similar to that obtained by adjoining several plates 104, as is represented in FIG. 7.

The plate 104, 104' used within the framework of the invention ultimately presents several advantages with respect to a hybrid slit such as presented in document D1. Indeed, the structure is simple, made from a single crystal. Moreover, this plate will usually be fixed at the ends of an enclosure under vacuum or under a controlled atmosphere, so that the manipulator will not be required to perform adjustments: the sole adjustment being the initial positioning of the plate. Furthermore, the fabrication method generally employed, chemical, generates an excellent surface state, which limits the risks of spurious scatterings.

The invention claimed is:

1. A collimation device for an X-ray beam, comprising:

an enclosure configured to be placed under vacuum or controlled atmosphere, the enclosure comprising an entrance and an exit for the X-ray beam, and at least one first plate made of a material with a diffracting periodic structure, the first plate comprising first and second principal faces and at least one first aperture broadening out between the first and second principal faces, wherein at least one of the first and second plates is made of a monocrystalline material.

2. The device as claimed in claim 1, in which the first principal face of the at least one first plate is an upstream face, with reference to a direction of propagation of the X-ray beam, and the second principal face is a downstream face, the first aperture widens out from the upstream face to the downstream face of the first plate.

3. The device as claimed in claim 1, in which the at least one first plate made of material with a diffracting periodic structure is arranged at a level of the exit of the enclosure.

4. The device as claimed in claim 3, further comprising, at a level of the entrance of the enclosure, at least one second plate made of a material with a diffracting periodic structure, the second plate comprising third and fourth principal faces and at least one second aperture broadening out between the third and fourth faces.

5. The device as claimed in claim 4, in which the third principal face of the at least one second plate is an upstream face, with reference to the direction of propagation of the beam, and the fourth principal face is a downstream face, and the second aperture widens out from the upstream face to the downstream face of the at least one second plate.

6. The device as claimed in claim 4, in which the first and second plates are identical.

7. The device as claimed in claim 4, in which the first and second plates exhibit different apertures.

8. The device as claimed in claim 1, in which an acute angle θ formed between a direction of broadening out of one of the apertures and one of the principal faces is between 10° and 80°.

9. The device as claimed in claim 8, in which the angle θ is equal to the angle between two crystalline planes of the monocrystalline material of diffracting periodic structure forming the first plate.

10. The device as claimed in the preceding claim, in which:

the principal faces of the plates correspond to the {100} plane of the monocrystalline material; and the faces of the apertures connecting the principal faces of this plate correspond to the {111} plane.

11. The device as claimed in claim 1, in which at least one of the first and second plates is made of a material chosen from among silicon or germanium.

12. An optical device for analyzing a specimen by scattering of an X-ray beam, comprising a device for collimating the beam as claimed in claim 1.

13. The optical device as claimed in claim 12, further comprising an X-ray source.

14. The optical device as claimed in claim 13, in which the X-ray source produces a monochromatic beam.

15. The optical device as claimed in claim 12, further comprising another enclosure configured to be placed under vacuum or controlled atmosphere, the other enclosure, arranged downstream of the specimen, comprising a means for stopping the X-ray beam.

16. The optical device as claimed in claim 15, further comprising a detector, arranged downstream of the other enclosure.

17. A collimator for an X-ray beam, comprising:

plural parts, of an X-ray aperture;

each part made of a monocrystalline material with a diffracting periodic structure, and comprising at least one aperture broadening out in the thickness thereof;

faces of the X-ray aperture, formed by assembling said plural parts, forming a sawtooth structure along a longitudinal axis of the X-ray aperture.

18. The collimator as claimed in claim 17, in which each of the parts is formed of a plate, the plates being adjoining.

19. The collimator as claimed in claim 18, in which the plates are identical.

20. A method for using a collimator for an X-ray beam, comprising:

illumination a specimen with X-rays;

wherein the collimator comprise at least one plate made of a monocrystalline material with a diffracting periodic structure, the plate comprising two principal faces and at least one aperture broadening out between the faces.

21. The method of claim 20, in which an acute angle θ formed between a direction of broadening out of the aperture and one of the principal faces is between 10° and 80°.

22. The method of claim 20, in which the collimator comprises plural identical plates adjoining one another.

* * * * *